US008474170B2

(12) United States Patent
Durham et al.

(10) Patent No.: US 8,474,170 B2
(45) Date of Patent: Jul. 2, 2013

(54) FIREARM SUPPORT DEVICES AND RELATED METHODS

(75) Inventors: Ernest M. Durham, Colton, WA (US); John R. Ader, Deer Park, WA (US)

(73) Assignee: Alliant Techsystems Inc., Arlington, VA (US)

( * ) Notice: Subject to any disclaimer, the term of this patent is extended or adjusted under 35 U.S.C. 154(b) by 248 days.

(21) Appl. No.: 12/551,274

(22) Filed: Aug. 31, 2009

(65) Prior Publication Data

US 2011/0048124 A1 Mar. 3, 2011

(51) Int. Cl.
*F41A 23/16* (2006.01)

(52) U.S. Cl.
USPC ..... 42/94; 73/167; 89/37.04

(58) Field of Classification Search
USPC ..... 42/94; 73/167; 89/37.01, 37.03, 89/37.04, 37.14
See application file for complete search history.

(56) References Cited

U.S. PATENT DOCUMENTS

| | | | | | |
|---|---|---|---|---|---|
| 1,457,407 | A | | 6/1923 | Stokes | |
| 2,731,829 | A | * | 1/1956 | Wigington | 73/167 |
| 2,817,233 | A | * | 12/1957 | Dower et al. | 73/167 |
| 2,983,142 | A | * | 5/1961 | McNally | 73/167 |
| 3,024,653 | A | | 3/1962 | Broadway | |
| 3,805,608 | A | | 4/1974 | Schmidt | |
| 4,012,860 | A | | 3/1977 | Auger | |
| 4,333,385 | A | | 6/1982 | Culver | |
| 4,409,826 | A | * | 10/1983 | Wenger | 73/167 |
| 4,428,122 | A | | 1/1984 | Mann | |
| 4,621,563 | A | | 11/1986 | Poiencot | |
| 4,893,545 | A | | 1/1990 | Sanderson et al. | |
| 5,056,410 | A | | 10/1991 | Pitts | |
| 5,067,268 | A | | 11/1991 | Ransom | |
| 5,070,636 | A | | 12/1991 | Mueller | |
| 5,081,783 | A | | 1/1992 | Jarvis | |
| 5,596,161 | A | * | 1/1997 | Sommers | 89/14.2 |
| 5,811,720 | A | | 9/1998 | Quinnell et al. | |
| 5,933,999 | A | | 8/1999 | McClure et al. | |
| 6,237,462 | B1 | | 5/2001 | Hawkes et al. | |
| 6,272,785 | B1 | | 8/2001 | Mika et al. | |
| 6,679,158 | B1 | | 1/2004 | Hawkes et al. | |
| 7,086,192 | B2 | | 8/2006 | Deros | |
| 7,406,794 | B1 | | 8/2008 | Pope, Jr. | |
| 2002/0178637 | A1 | | 12/2002 | Graham | |
| 2007/0068379 | A1 | | 3/2007 | Sween et al. | |
| 2007/0256346 | A1 | | 11/2007 | Potterfield et al. | |
| 2008/0110074 | A1 | | 5/2008 | Bucholtz et al. | |

* cited by examiner

*Primary Examiner* — Gabriel Klein
(74) *Attorney, Agent, or Firm* — TraskBritt

(57) ABSTRACT

A firearm support device includes a carriage movably coupled to a base structure. Movement of the carriage is restricted to a single axis of direction. The firearm support device may also include an attachment feature for mounting a portion of a firearm and a striker assembly for triggering a projectile. A firearm support device may include a carriage slidably coupled to rails of a base structure restricting movement of the carriage to a single axis of direction. The firearm support device may also include an attachment feature for mounting a firearm and a biasing feature coupled to the carriage and the base structure biasing the carriage in an initial position. A method of testing a firearm may include removing a barrel from a firearm, mounting the barrel to a support device, restricting the barrel to a single axis of movement, and firing a projectile with a firing pin.

14 Claims, 7 Drawing Sheets

FIREARM SUPPORT DEVICES AND RELATED METHODS

TECHNICAL FIELD

The invention generally relates to firearm support devices. In particular, embodiments of the invention relate generally to firearm support devices for testing firearms, firearm support devices for testing portions of disassembled firearms, and methods of testing firearms and disassembled portions thereof.

BACKGROUND

Firearm supports are utilized to eliminate artifact attributable to human movement during the firing of the firearm. The accuracy and consistency of a firearm may be determined by using a firearm support to eliminate human movement during shooting. As most modern firearms are mass-produced with interchangeable parts that have a range of acceptable tolerances, accurizing an individual firearm can significantly improve its accuracy. The goal of accurizing a firearm is to improve the consistency of firing each projectile (e.g., ammunition). The accuracy and consistency of a firearm are typically determined by placing the firearm in a shooting support, firing several shots at a target, and measuring the distance between the two holes that are spaced apart by the largest distance (i.e., the group size). Firearm supports may also be used in a similar manner to determine the accuracy differences between similar firearms and may be used to test the accuracy of the ammunition, and various makes of ammunition, used in the firearm.

A conventional shooting support for testing a firearm 12 is shown in FIG. 1. A shooting rest 10 (otherwise known as a ransom rest) includes a base 16 and a pivot arm 14 attached to the base 16. The pivot arm 14 is pivotable about an axis Z. A spring 18 having a longitudinal axis along the axis Z is attached to the base 16 and the pivot arm 14. A triggering mechanism 20 is attached to the pivot arm 14. When a shooter actuates the triggering mechanism 20 and discharges the firearm 12, the recoil of the firearm 12 pivots the pivot arm 14 and the firearm 12 rotationally about the axis Z from the firing position to a recoil position in which the firearm 12 is aimed upward. The spring 18 slows and eventually stops the rotation of the pivot arm 14 and the firearm 12 about the axis Z so that the pivot arm 14 and the firearm 12 remain in the recoil position. After discharge, the shooter manually pivots the pivot arm 14 and the firearm 12 from the recoil position back to the firing position to discharge another shot.

The conventional shooting rest 10 shown in FIG. 1 is generally limited in use to the testing of handguns. The shooting rest 10 uses specially formed grip panels that are custom made to fit each style of handgun and may only be used with handguns that can fit in the custom-made grip panels. Similarly, other shooting supports designed to hold a firearm larger than a handgun are generally limited to only accommodating certain types of firearms as well. One such example of a shooting support for a rifle is illustrated by the gun sighting apparatus disclosed in U.S. Pat. No. 4,333,385 to Culver. Culver describes an apparatus for adjusting gun sights, particularly telescopic sights on rifles. The rifle is mounted upon and rigidly clamped to a gun support including a pair of spaced cradles. One cradle supports the barrel of the rifle and the other cradle supports the butt of the rifle stock.

BRIEF SUMMARY

In one embodiment, the present invention includes a firearm support device comprising a base structure and a carriage movably coupled to the base structure. The direction of movement of the carriage is restricted with respect to the base structure to a single axis. The firearm support device may also include an attachment feature coupled to the carriage, which is configured to mount a portion of a firearm to the carriage and a striker assembly for triggering a projectile loaded into a firearm.

In additional embodiments, the present invention includes a firearm support device comprising a base structure including at least two rails coupled to the base structure and a carriage including at least two bearing assemblies slidably coupled to the at least two rails of the base structure. The at least two bearing assemblies are slidably coupled to the at least two rails in order to restrict the direction of movement of the carriage to a single axis relative to the base structure. The firearm support device may also include an attachment feature for mounting a firearm to the carriage and a biasing feature biasing the carriage in a first position relative to the base structure. The biasing feature may be coupled to both the carriage and the base assembly.

In yet additional embodiments, the present invention includes a method of testing a firearm. The method may include removing a barrel from a firearm, mounting the barrel in a firearm barrel clamp coupled to a firearm support device, restricting movement of the barrel to a single axis, and firing a projectile from the barrel of the firearm with a triggering element.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of embodiments of the invention when read in conjunction with the accompanying drawings in which:

DETAILED DESCRIPTION

The illustrations presented herein are not meant to be actual views of any particular material, apparatus, system, or method, but are merely idealized representations which are employed to describe embodiments of the present invention. Additionally, elements common between figures may retain the same numerical designation for convenience and clarity.

As used herein, the term "firearm" means a weapon used to fire a projectile or a portion of weapon capable of firing a projectile. For example, a firearm means a weapon such as a rifle and a firearm may also mean of portion of a disassembled weapon such as the disassembled barrel of weapon that is capable of firing a projectile either alone or in combination with another element such as, for example, a triggering element.

Figure 1:
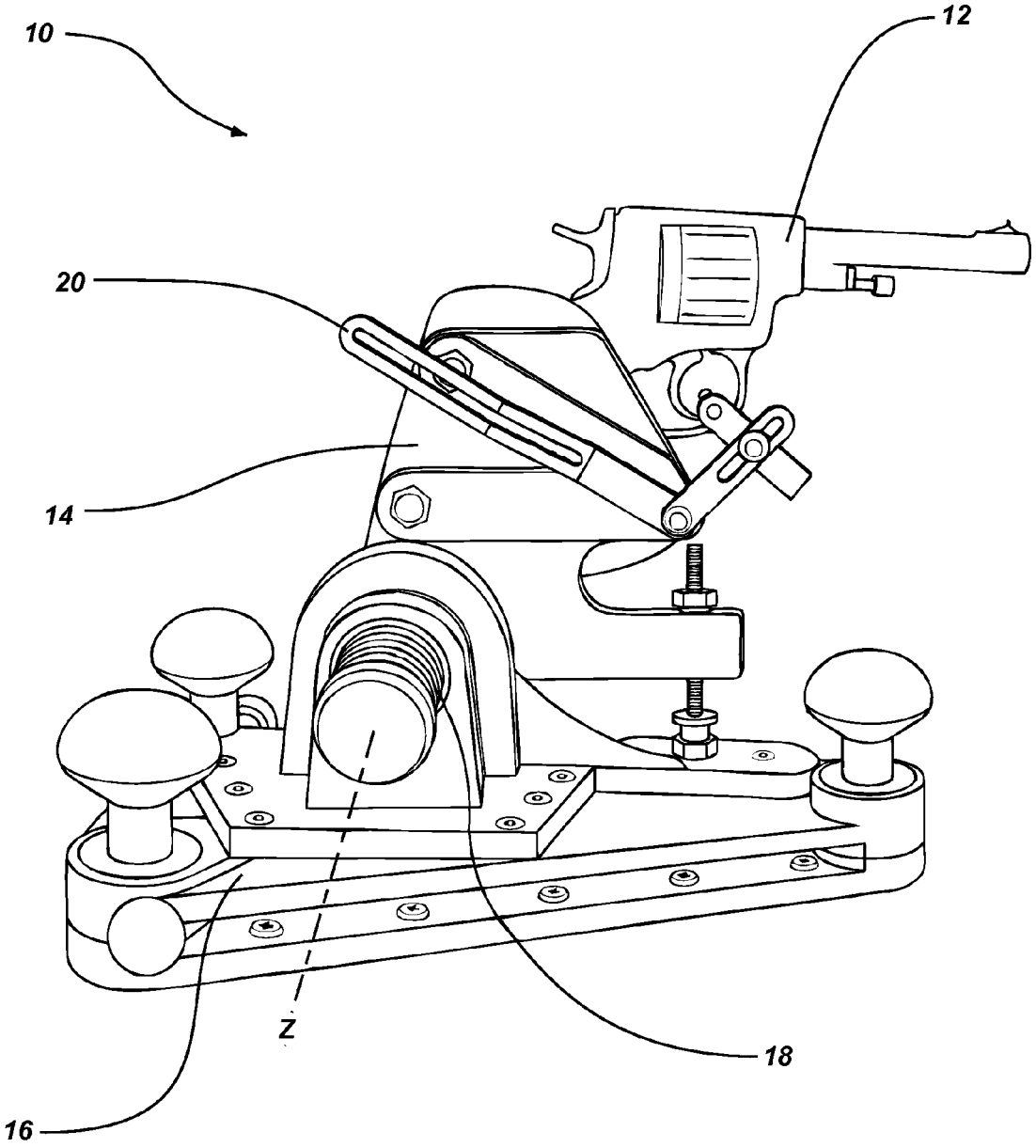
FIG. 1 Prior Art
FIG. 1 is a perspective view of a conventional shooting rest for testing a firearm.
Figure 2:
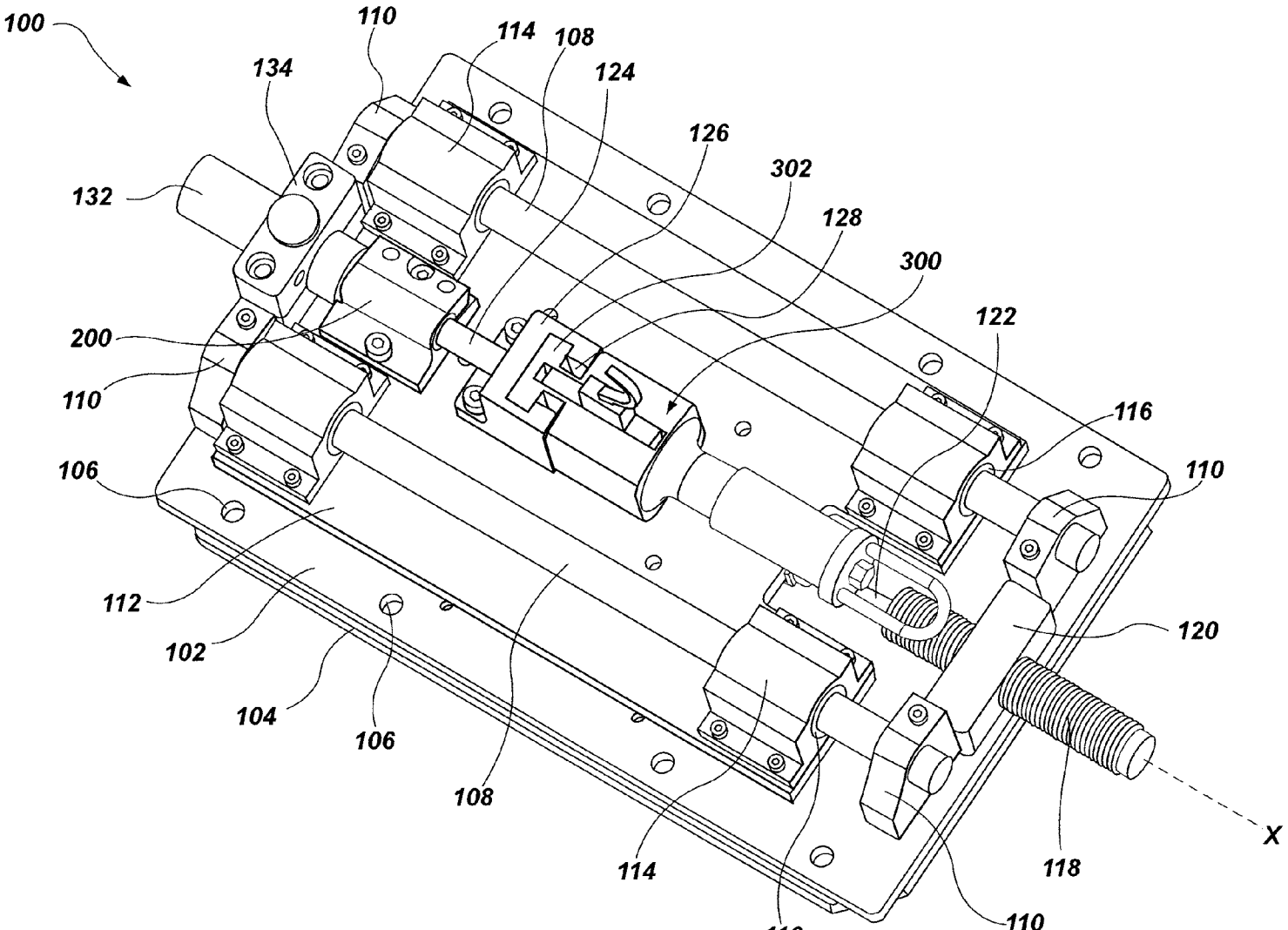
FIG. 2 is a perspective view of a firearm support fixture including a striker assembly in accordance with an embodiment of the present invention.

FIG. 2 is a perspective view of a firearm support device such as the firearm support fixture 100 including a striker assembly that may be used to test a firearm. As shown in FIG. 2, the firearm support fixture 100 may include a base assembly 102. The base assembly 102 may couple to a support structure 104 to secure the firearm support fixture 100, for example, during testing of a firearm (not shown). In some embodiments, the base assembly 102 may include a plurality of holes 106 formed therein to receive fasteners (not shown) to couple the base assembly 102 to the support structure 104. It is noted that while the embodiment of FIG. 2 illustrates holes 106 formed in the base assembly 102, the base assembly 102 may be attached to a support structure 104 by any suitable means.

The base assembly 102 may further include a support assembly for supporting a firearm. For example, the support assembly may include support rails 108 coupled to the base assembly 102. Each of the rails 108 may extend along the base assembly 102 and may be coupled to the base assembly 102 by rail mounts 110. The rail mounts 110 may space the rails 108 from a surface of the base assembly 102. In some embodiments, the rail mounts 110 may couple with an end portion of each of the rails 108.

A carriage 112 may be movably coupled to and supported by the rails 108. In some embodiments, the carriage 112 may be slidably coupled to the rails 108 of the base assembly 102 by bearing assemblies 114. The bearing assemblies 114 may receive a portion of the rails 108. The portions of the rails 108 may extend through bearings 116 (e.g., sliding bearings such as bushings) housed in the bearing assemblies 114. The bearings 116 of the bearing assemblies 114 may allow the bearing assemblies 114 to slide on the rails 108 of the base assembly 102. The bearings 116 and the bearing assemblies 114 may translate back and forth on the rails 108 and may restrict movement of the carriage 112 to a single axis (i.e., one axis) of direction. For example, as shown in FIG. 2, the carriage 112 may include bearing assemblies 114 surrounding a portion of the each of the rails 108. As the bearings 116 slide on the rails 108 the carriage 112 is allowed to move in only one direction substantially parallel to the longitudinal axis of the rails 108 (e.g., the single axis of direction illustrated by axis X). It is noted that while the embodiment of FIG. 2 illustrates two bearing assemblies 114 slidably coupled to each of the rails 108, the carriage 112 may include more or less bearing assemblies 114. For example, the carriage 112 may only include one bearing assembly 114 coupled to each of the rails 108.

In some embodiments, the bearing assemblies 114 may couple with the rails 108 to form a gap between the carriage 112 and the base assembly 102. In some embodiments, the base assembly 102 and the carriage 112 may be substantially parallel to one another. For example, the carriage 112 and the base assembly 102 may be spaced such that the carriage 112 floats over the base assembly 102 (i.e., the carriage 112 moves back and forth on the rails 108 while not contacting the base assembly 102). In some embodiments, sliding elements such as, for example, bearings or the like may be disposed between the carriage 112 and the base assembly 102. It is further noted that while the embodiment of FIG. 2 illustrates the carriage 112 and the base assembly 102 located proximate to each other, in some embodiments, the rails 108 may be disposed between the carriage 112 and the base assembly 102 (i.e., the carriage 112 and the base assembly 102 may be separated by the rails 108).

The base assembly 102 may further include a biasing feature (e.g., a shock absorber, a spring, etc.) to bias the carriage 112 in a position on the base assembly 102. For example, a shock absorber 118 may be coupled to the base assembly 102 by a shock absorber mount 120. A portion of the shock absorber 118 such as, for example, a rod 122 may be coupled to the carriage 112. In some embodiments, the shock absorber 118 may be mounted to the base assembly 102 by the shock absorber mount 120 such that the rod 122 of the shock absorber 118 moves in a direction substantially parallel to the longitudinal axis of the rails 108. The shock absorber 118 may allow the bearing assemblies 114 of the carriage 112 to move along the rails 108 and may bias the carriage 112 to an initial position. For example, the shock absorber 118 may bias the carriage 112 in an initial position toward a first side of the base assembly 102 (e.g., a side of the base assembly 102 proximate to a muzzle of a firearm mounted to the base assembly 102). A force applied to the carriage 112 may move the carriage 112 along the rails 108 against the force exerted by the shock absorber 118 toward a second side of the base assembly 102 (e.g., a side of the base assembly 102 opposite to the first side). When the force applied to move the carriage 112 is less than the force applied by the shock absorber 118, the shock absorber 118 will move the carriage 112 back to the initial position. In some embodiments, the shock absorber 118 may act to counter the force generated by the firing of a firearm or a portion of a firearm (e.g., a barrel 124 of a firearm) on the carriage 112. For example, the recoil force generated by a projectile being fired from a firearm may apply a force to the barrel 124 and the carriage 112. The recoil force may move the barrel 124 and the carriage 112 toward the shock absorber 118 in a direction opposite to the trajectory of the projectile due to the recoil produced by the firing of the projectile. The shock absorber 118 may allow the carriage 112 to move a distance along the rails 108. As the carriage 112 moves toward the shock absorber 118, the shock absorber 118 may counteract the recoil force and dampen the movement of the carriage 112. After absorbing the recoil force, the shock absorber 118 may return the carriage 112 to its original initial position. Stated in other words, the bearing assemblies 114 sliding on the rails 108 restricts the movement of the carriage 112 to a single axis X of movement in a direction substantially parallel to the trajectory of the projectile. The shock absorber 118 slides the carriage 112 on the rails 108 to return the carriage 112 to its initial position to fire another projectile. In this manner, the carriage 112 may return the barrel 124 after firing to substantially the exact position that the barrel 124 was located at before the firing of the projectile.

The carriage 112 may include an attachment feature to secure a firearm or a portion of the firearm thereto. For example, the carriage 112 may include a clamp 200. The clamp 200 may receive a portion of a firearm such as, for example, the barrel of a firearm or, as shown in FIG. 2, the barrel 124 of a disassembled firearm. In some embodiments, the clamp 200 may receive the action of a firearm. The action of a firearm may include the portion of the firearm into which cartridges (e.g., ammunition including a projectile and a casing containing a propellant to which the projectile is affixed) are loaded and extracted such as, for example, the action of a firearm (e.g., the bolt action of a Remington 700). An action removed from a firearm may be mounted to the clamp 200 on the carriage 112 of the firearm support fixture 100 in a manner similar to the mounting of the barrel 124 in the clamp 200 discussed in further detail below.

Figure 3A:
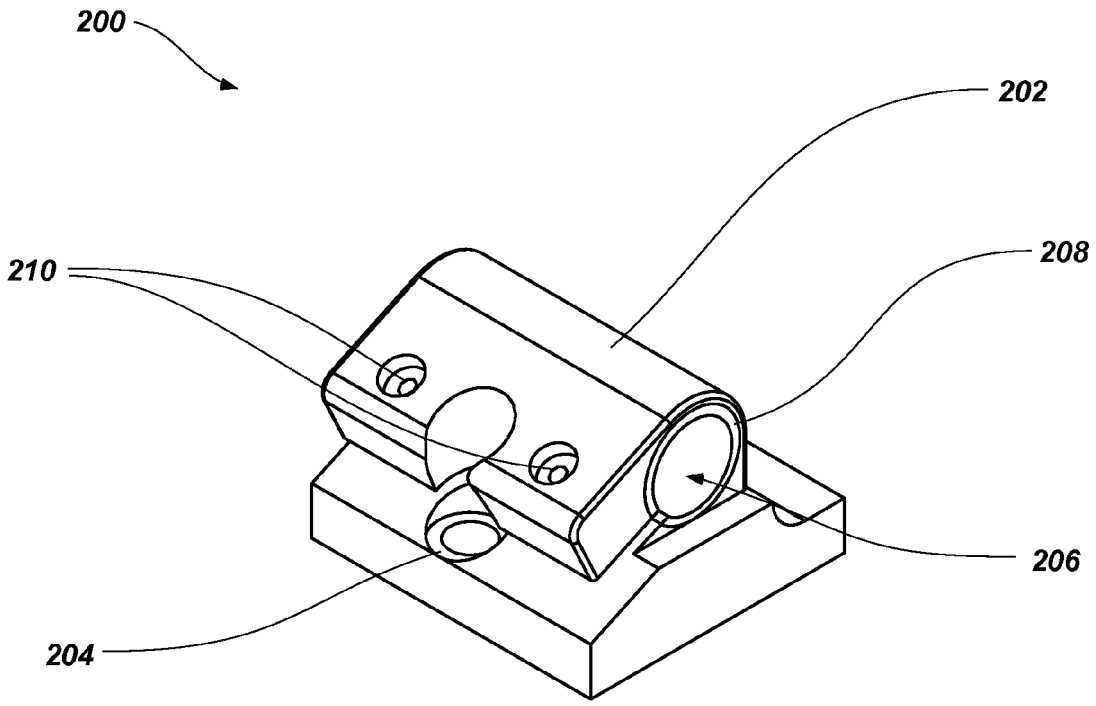
FIGS. 3A and 3B are a perspective view and a side view, respectively, of the clamp shown in FIG. 2.
Figure 3B:
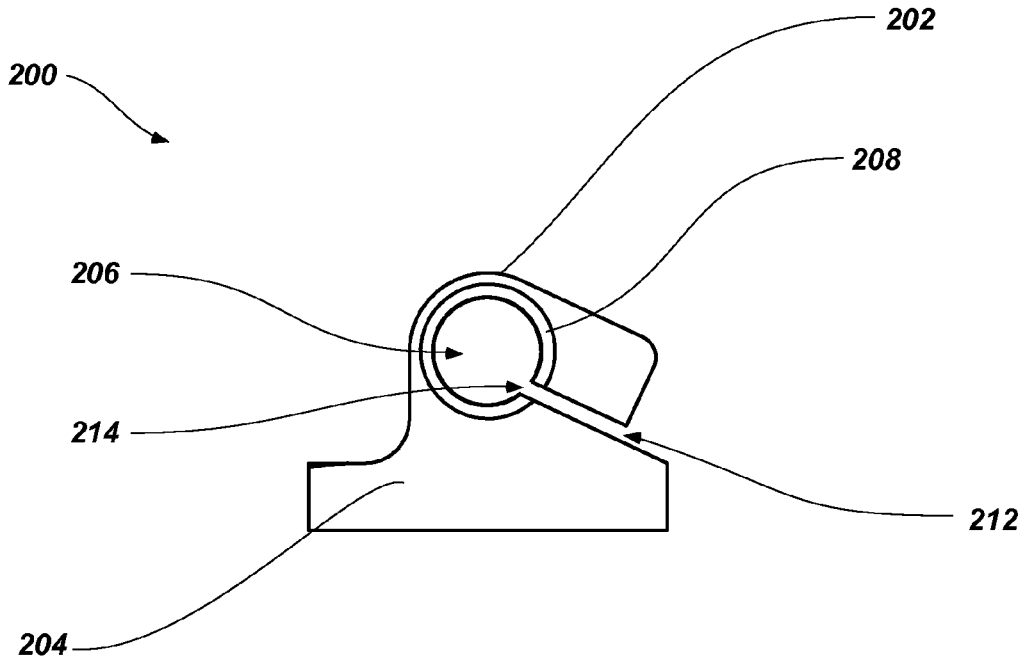

As shown in further detail in FIGS. 3A and 3B, in some embodiments, the clamp 200 may comprise a deformable clamp 200. The clamp 200 may include a housing portion 202 and a base portion 204. The base portion 204 of the clamp 200 may be coupled to the carriage 112 (FIG. 2). The housing portion 202 of the clamp 200 may include a recess 206 for receiving a portion of a firearm (e.g., the barrel 124 (FIG. 2)). The housing portion 202 may also include a flexible bushing 208 (e.g., a polymer bushing, a rubber bushing, etc.) disposed in the recess 206 of the housing portion 202. The housing portion 202 may further include a tightening mechanism such as, for example, fasteners 210 (e.g., bolts, screws, etc.) for tightening the housing portion 202 and the flexible bushing 208 around a portion of a firearm (not shown). The housing portion 202 may include a gap 212 between the base portion 204 and the housing portion 202 of the clamp 200. Tightening the fasteners 210 may decrease the gap 212 between the base portion 204 and the housing portion 202 of the clamp 200 and may secure a portion of a firearm within the recess 206 of the clamp 200. For example, a barrel 124 (FIG. 2) of a firearm may be received in the flexible bushing 208 disposed in the recess 206 of the housing portion 202. The fasteners 210 may be tightened to secure the barrel 124 in the clamp 200. As the fasteners 210 are tightened, the gap 212 between the base portion 204 and the housing portion 202 of the clamp 200 is reduced and the flexible bushing 208 is tightened around the barrel 124 as walls of the housing 202 surrounding the recess 206 tighten around the flexible bushing 208. In some embodiments, the flexible bushing 208 may comprise a split bushing with a gap 214 extending longitudinally along the flexible bushing 208. The gap 214 in the split flexible bushing 208 may enable the flexible bushing 208 to substantially surround a portion of a firearm in the clamp 200 and to protect a firearm from damage and distortion due to the clamping of the firearm in a firearm support such as the clamp 200.

Referring back to FIG. 2, the firearm support fixture 100 may further include a triggering assembly for triggering a firearm. For example, a striker assembly 300 may be used to initiate a projectile loaded into the barrel 124 of a firearm. The striker assembly 300 may be removably mounted to the carriage 112 of the firearm support fixture 100 by a striker assembly mount 126. In some embodiments, the striker assembly 300 may cooperatively mate with a portion of the striker assembly mount 126. For example, as shown in further detail in FIG. 5, a T-shaped cutout portion 128 of the striker assembly mount 126 may cooperatively mate with the striker assembly 300. Referring still to FIG. 2, the striker assembly 300 may have a substantially T-shaped portion 302 (shown in further detail in FIGS. 4A and 4B) cooperatively formed to fit within the T-shaped cutout portion 128 of the striker assembly mount 126. The striker assembly 300 may be removably mounted by sliding the T-shaped portion 302 of the striker assembly 300 into the T-shaped cutout portion 128 of the striker assembly mount 126. It is noted that while the embodiment of FIG. 2 illustrates the striker assembly 300 and striker assembly mount 126 having cooperative T-shaped portions 128, 302, the striker assembly 300 may be retained by the carriage 112 and the striker assembly mount 126 by any suitable means. In some embodiments, the striker assembly 300 may not be removably mounted to the carriage 112 and may be placed adjacent to the carriage 112 to trigger a firearm.

Figure 4A:
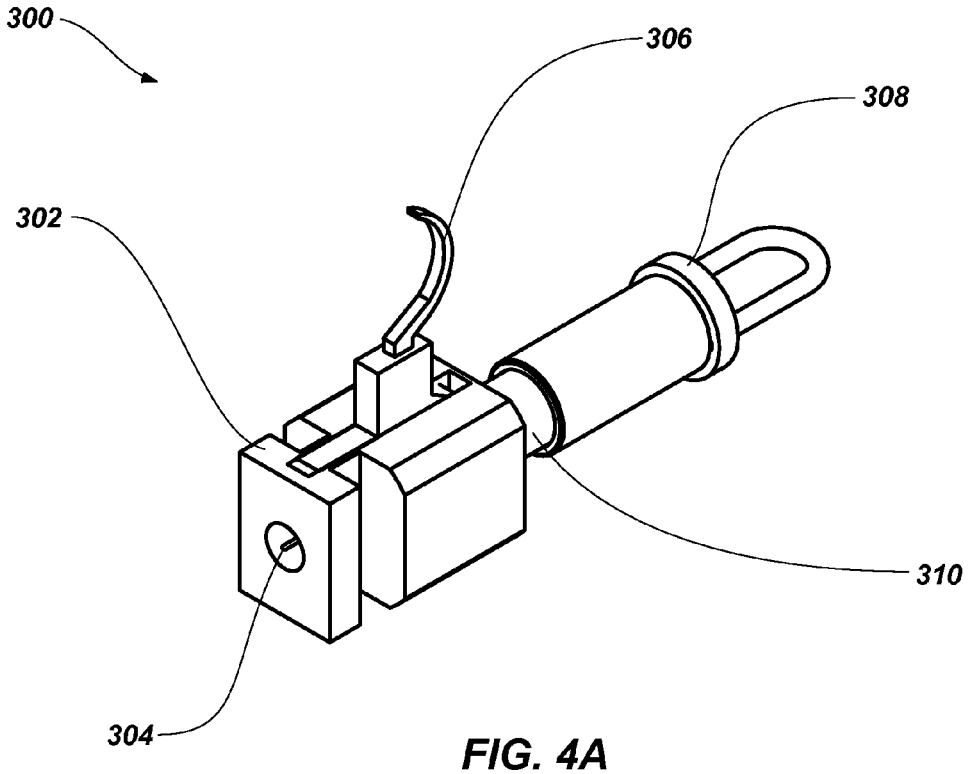
FIGS. 4A and 4B are a perspective view and a side view, respectively, of the striker assembly shown in FIG. 2.
Figure 4B:
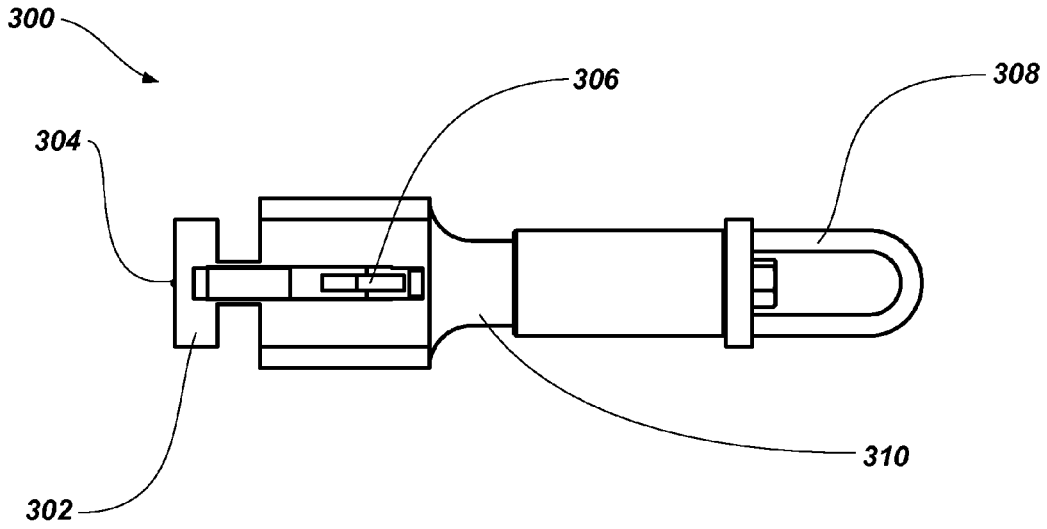

As shown in further detail in FIGS. 4A and 4B, the striker assembly 300 includes a mounting portion (e.g., the T-shaped portion 302 described above with reference to FIG. 2). The striker assembly 300 may further include a triggering element. For example, the striker assembly 300 may include a firing pin 304 to initiate a projectile (not shown) placed in a firearm (e.g., the barrel 124 (FIG. 2)). In some embodiments, the striker assembly 300 may include an additional triggering element such as, for example, a trigger 306 to actuate the firing pin 304. The trigger 306 may work similar to a trigger of a conventional firearm by causing the firing pin 304 to strike the cartridge containing the projectile (e.g., the ammunition), thereby, initiating explosive material contained in the cartridge. The striker assembly 300 may also include a handle 308 and a shaft 310. In some embodiments, the handle 308 and the shaft 310 may act as the triggering element. For example, the handle 308 may be slidably coupled to the shaft 310 to allow the handle 308 to move along the shaft 310 and to actuate the firing pin 304. The handle 308 may be coupled to the shaft 310 and may be biased to an initial position. The handle 308 may move along the shaft 310 and may be released to return the handle 308 to the initial position and to actuate the firing pin 304. When the handle 308 is released, the force applied by a biasing element (e.g., a spring) to the handle 308 may actuate the firing pin 304 to initiate the projectile. In this manner, the movement of the handle 308 and the firing pin 304 may travel in the same axis of direction (i.e., a direction substantially parallel to the longitudinal axis of the rails 108 (FIG. 2)) and may minimize extraneous forces on the projectile and firearm support fixture 100 (FIG. 2) that may affect the accuracy of the projectile.

Referring again to FIG. 2, the firearm support fixture 100 may further include a flash tube 132 mounted on the firearm support fixture 100 by a flash tube mount 134. A portion of the barrel 124 of the firearm may be received within the flash tube 132. The flash tube 132 may surround the portion of the barrel 124 while allowing the barrel 124 to move on the carriage 112 as a projectile is initiated and discharged from the barrel 124. The flash tube 132 may act to direct the release of hot, high pressure gases (i.e., muzzle flash) from the end of the barrel 124 of the firearm away from the firearm support fixture 100 as the projectile is initiated and discharged from the barrel 124. In some embodiments, the flash tube 132 may be mounted on the carriage 112 and may move in unison with the barrel 124 as a projectile is initiated and discharged from the barrel 124.

Figure 5:
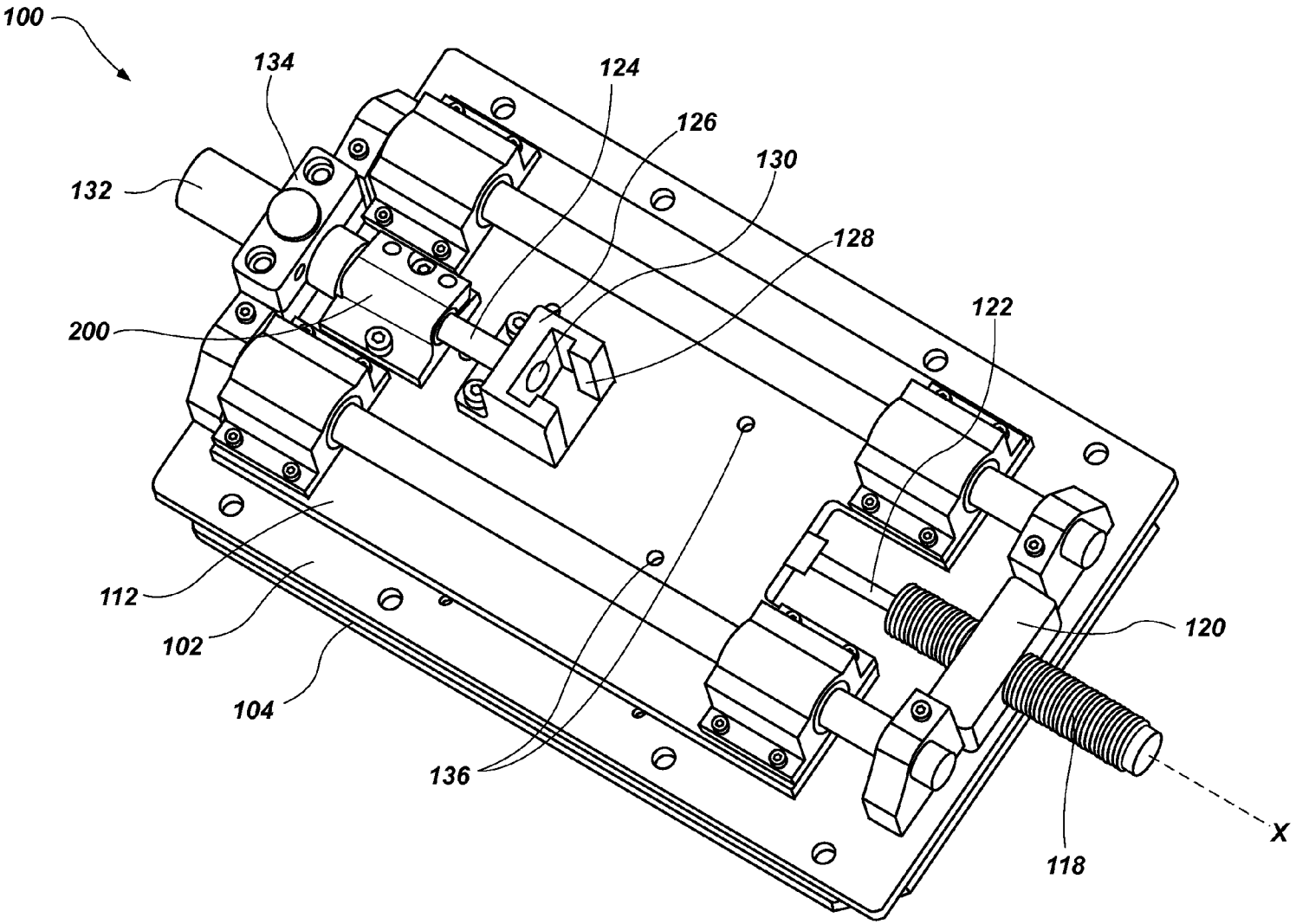
FIG. 5 is a perspective view of the firearm support fixture of FIG. 2 with the striker assembly removed.

FIG. 5 is a perspective view of the firearm support fixture 100 of FIG. 2 with the striker assembly 300 removed. As shown in FIG. 5, the striker assembly mount 126 is coupled to the carriage 112 and includes the T-shaped cutout portion 128 that cooperatively mates with a portion of the striker assembly 300 (FIG. 2). The striker assembly mount 126 may include an aperture 130. The aperture 130 may allow the firing pin 304 of the striker assembly 300 (FIGS. 4A and 4B) to contact a projectile placed within the barrel 124 (FIG. 2). In some embodiments, a portion of the barrel 124 may be received within the aperture 130 and may be positioned adjacent to the firing pin 304 (FIGS. 4A and 4B).

As also shown in FIG. 5, the shock absorber 118 is coupled to the base assembly 102 by a shock absorber mount 120 and is also coupled to the carriage 112 (e.g., the rod 122 of the shock absorber 118 extends to the carriage 112 and may be coupled thereto).

In some embodiments, the striker assembly mount 126, the clamp 200, and the flash tube mount 134 may be removably coupled to the carriage 112 by fasteners (e.g., a screw, bolt, rivet, latch, etc.) such that the striker assembly mount 126, the clamp 200, and the flash tube mount 134 may be removed and may enable the firearm support fixture 100 to be used for a variety of firearms as discussed below with regard to FIGS. 6 and 7. The carriage 112 may further include mounting holes 136 located on the carriage 112. With the striker assembly mount 126, the clamp 200, and the flash tube mount 134 removed, the mounting holes 136 may mount a portion of an assembled firearm as also described below in further detail.

Figure 6:
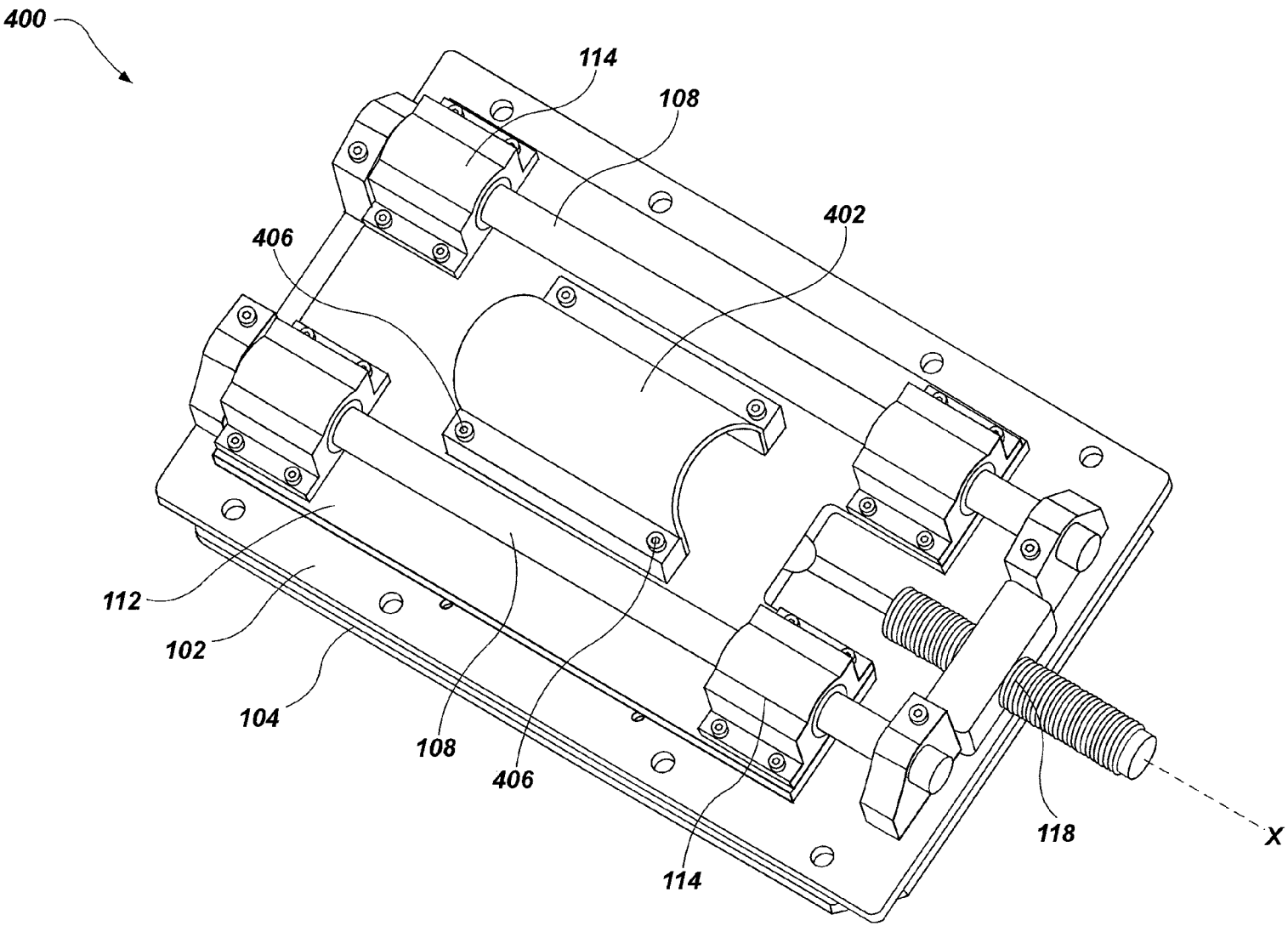
FIG. 6 is a perspective view of a firearm support fixture including a firearm forend clamp in accordance with another embodiment of the present invention.

FIG. 6 is a perspective view of a firearm support fixture 400 in accordance with another embodiment of the present invention. The firearm support fixture 400 may be similar to the firearm support fixture 100 shown and described with reference to FIG. 2. However, the striker assembly mount 126, the clamp 200, and the flash tube mount 134 have been removed allowing for greater flexibility in mounting firearms of varying sizes and for mounting assembled firearms. For example, the firearm support fixture 400 may include a clamp 402. The clamp 402 may be mounted to the carriage 112 of the firearm support fixture 400 by fasteners 406 received within the mounting holes 136 (FIG. 5). The clamp 402 may secure a portion of a firearm (e.g., the forend of a firearm). In some embodiments, the clamp 402 may be substantially similar to the clamp 200 shown and described with reference to FIGS. 3A and 3B. The clamp 402 may secure a portion of a firearm to the carriage 112 and may position the portion of the firearm between the rails 108. The clamp 402 may also position a firearm such that a longitudinal axis of the firearm is substantially parallel with the longitudinal axes of the rails 108. When a firearm is discharged, the recoil force generated may move the carriage 112 and the firearm mounted thereto may move along the axis X. For example, the clamp 402 may mount a forend of a firearm to the carriage 112 of the firearm support fixture 400. The clamp 402 may surround the portion of the firearm and secure the firearm on the carriage 112. The firearm may be triggered to fire a projectile and the carriage 112 may move in a direction opposite to the trajectory of the projectile. The bearing assemblies 114 sliding on the rails 108 may restrict the carriage 112 to one axis of movement (e.g., the axis X). The shock absorber 118 may allow the carriage 112 to move a predetermined distance and return the carriage 112 to an initial position.

Figure 7:
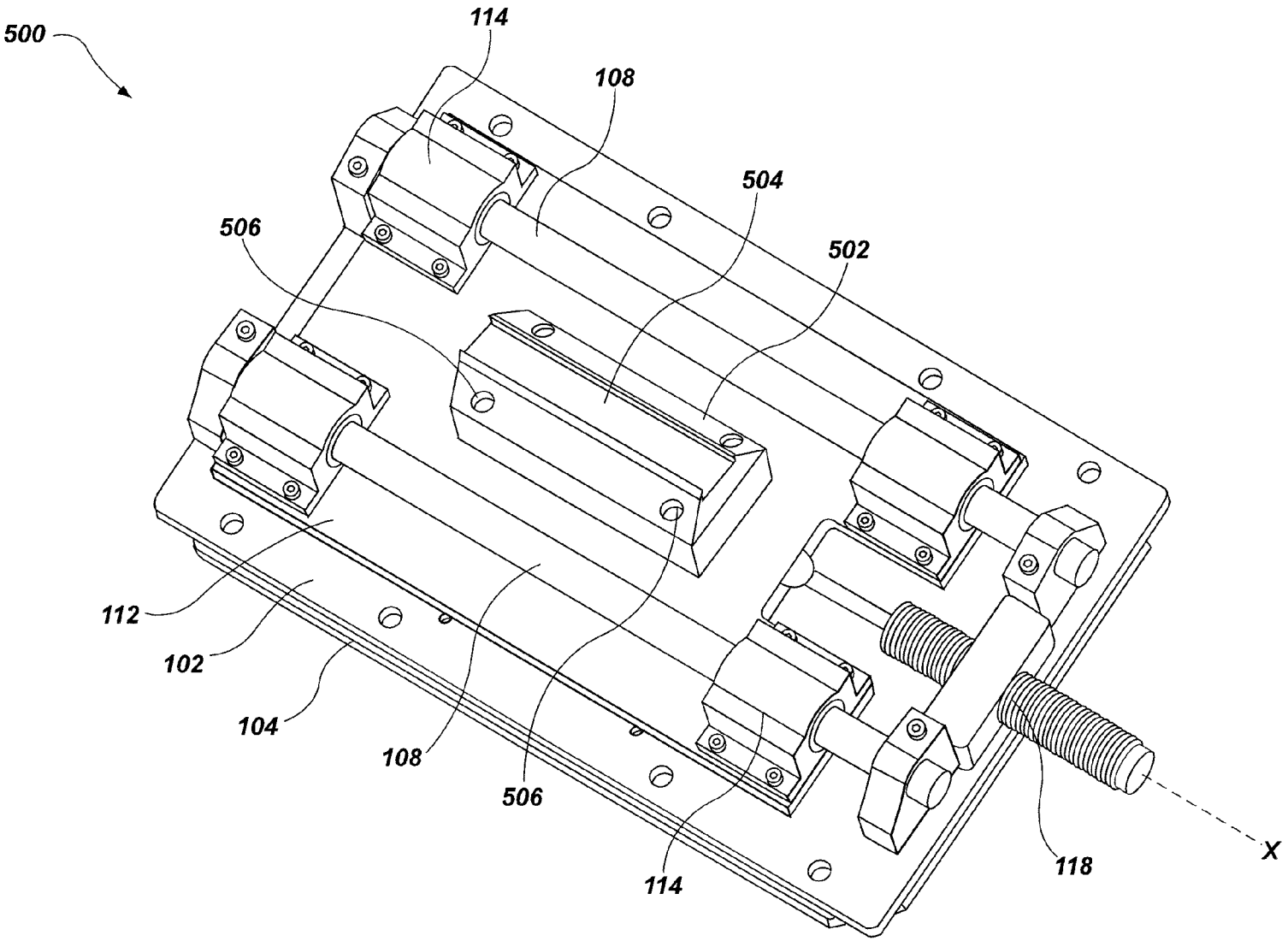
FIG. 7 is a perspective view of a firearm support fixture including a firearm mount in accordance with yet another embodiment of the present invention.

FIG. 7 is a perspective view of a firearm support fixture 500 in accordance with yet another embodiment of the present invention. The firearm support fixture 500 may be similar to the firearm support fixture 100 shown and described with reference to FIG. 2. Similar to the firearm support fixture 400 shown in FIG. 6, the striker assembly mount 126, the clamp 200, and the flash tube mount 134 have been removed allowing for greater flexibility in mounting firearms of varying sizes and for mounting assembled firearms. The firearm support fixture 500 may include a mount 502 removably coupled to the carriage 112 of the firearm support fixture 500 by fasteners 506 received within the mounting holes 136 (FIG. 5). The mount 502 may attach to a portion of a firearm or an accessory mount coupled to a firearm to the carriage 112. For example, accessory rails such as, for example, an M1913 rail, Picatinny rail, Weaver rail, etc. include a bracket to provide standardized mounting of accessories (e.g., a scope) on firearms. The bracket provided by an accessory rail of a firearm may be used to mount a firearm to the mount 502 of the firearm support fixture 500. The mount 502 may include a channel 504 that is complementary to the standardized bracket provided on a firearm accessory rail. The accessory rail may be received in the channel 504 of the mount 502 and may be secured thereto using a fastener (e.g., a setscrew, a thumbscrew, a lever, etc.). Similar to the above-described firearm fixtures, the mount 502 may position a portion of a firearm between the rails 108 and may also position a firearm such that a longitudinal axis of the firearm is substantially parallel with the longitudinal axes of the rails 108.

Referring again to FIG. 2, a method of testing a firearm is discussed. The method of testing a firearm may include removing the barrel 124 from the firearm, mounting the barrel 124 in a firearm barrel clamp 200 coupled to a firearm support device 100, and firing a projectile from the barrel 124 of the firearm with a triggering element such as, for example, the firing pin 304 (FIGS. 4A and 4B). Firing the projectile may also include actuating the firing pin 304 with a striker assembly 300.

The firing of the projectile from the barrel 124 by the firing pin 304 (FIGS. 4A and 4B) causes the carriage 112 to move away from its initial position in a direction opposite to the trajectory of the projectile due to the recoil produced by firing the projectile. The shock absorber 118 may absorb the recoil force and may reset the carriage 112 of the firearm support fixture 100 to its original initial position. The bearing assemblies 114 sliding on the rails 108 may restrict the carriage 112 and the barrel 124 secured thereto to a single axis of movement (e.g., the axis X). By restricting the movement in a direction substantially parallel to the trajectory of the projectile, the recoil force may be absorbed and the firearm may return to its initial position to fire another projectile.

In view of the above, embodiments of the present invention may be particularly useful in testing the accuracy of a firearm while removing inconsistencies in aiming the firearm due to human operation of the firearm and removing inaccuracies caused by mechanical components of the firearm. By restricting the firearm support fixture to a single axis of movement, projectiles may be repeatedly fired in a manner more consistent than other similar firearm support devices. The firearm support device returns the firearm to the same position for the firing of subsequent shots. By mounting only a portion of a firearm, inaccuracies due to mechanical components of the firearm may be limited or, in some configurations, eliminated. Further, embodiments of the present invention enable a variety of firearm types and firearms of differing caliber to be mounted to the compact firearm support fixture. Such firearms include, for example, rifles, shotguns, revolvers, pistols, handguns, etc. Embodiments of the present invention may also be particularly useful in clamping and mounting firearms and portions of firearms to the firearm support fixture in a manner that will not damage the firearms and do not require that the firearm be modified to mount the firearm to the fixture.

While the present invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, legal equivalents, and alternatives falling within the spirit and scope of the invention as defined by the following appended claims.

What is claimed is:

1. A firearm support device comprising:

a base structure comprising:

at least two rails; and a plurality of rail mounts coupled to and extending from a surface of the base structure, wherein each rail of the at least two rails is coupled to the base structure by at least two rail mounts of the plurality of rail mounts;

a carriage having a first surface positioned adjacent to the surface of the base structure and a second, opposing surface positioned relatively further away from the surface of the base structure than the first surface, the carriage comprising at least two bearing assemblies coupled to and extending from the second surface of the carriage, the at least two bearing assemblies slidably coupled to the at least two rails of the base structure, each of the at least two bearing assemblies slidably coupled to a rail of the at least two rails to restrict movement of the carriage to a single axis of direction relative to the base structure, wherein the carriage is positioned between the at least two rails and the base structure, and wherein the carriage is further positioned between the at least two bearing assemblies and the base structure;

an attachment feature coupled to and extending from the second surface of the carriage for mounting at least a portion of a firearm to the carriage, wherein the attachment feature is positioned on the carriage to fix a longitudinal axis of a barrel of a firearm mounted thereto parallel with and between longitudinal axes of each of the at least two rails; and a biasing feature biasing the carriage in a first position relative to the base structure, the biasing feature coupled to the carriage and to the base assembly;

a striker assembly for triggering a projectile loaded into a portion of a firearm; and a striker holder coupled directly to the carriage and configured to cooperatively receive a portion of a housing of the striker assembly within the striker holder and position the striker assembly relative to the attachment feature.

2. The firearm support device of claim 1, wherein the striker assembly comprises a housing, a firing pin, and a triggering element, the triggering element configured to displace the firing pin into contact with a projectile loaded in the portion of a firearm.

3. The firearm support device of claim 1, wherein the firing pin and the triggering element of the striker assembly are configured to displace along the single axis of direction.

4. The firearm support device of claim 1, wherein the striker holder comprises a hole to receive a portion of a firearm.

5. The firearm support device of claim 1, wherein the attachment feature comprises a clamp for receiving a portion of a firearm.

6. The firearm support device of claim 5, wherein the clamp comprises a deformable clamp having a recess and a flexible bushing disposed in the recess for receiving at least one of a barrel of a firearm and an action of a firearm.

7. The firearm support device of claim 6, further comprising a flash tube coupled to the at least one of the carriage and the base structure, the flash tube at least partially surrounding a portion of the at least one of a barrel of a firearm and an action of a firearm.

8. The firearm support device of claim 1, wherein the base structure includes a plurality of holes configured to receive a plurality of fasteners to secure the base structure to a support structure.

9. The firearm support device of claim 1, wherein the attachment feature comprises a clamp coupled to the carriage, the clamp having a semicircular shape to extend around a portion of a firearm.

10. The firearm support device of claim 9, wherein the clamp is configured to extend around a forend of a firearm.

11. The firearm support device of claim 1, wherein the firearm support device is configured to couple to the at least a portion of a firearm at only one location.

12. The firearm support device of claim 1, wherein the striker holder is configured to position a firing pin of the striker assembly adjacent to a portion of a firearm.

13. The firearm support device of claim 1, wherein the attachment feature comprises a mount coupled to the carriage, the mount sized and configured to receive an accessory rail of a firearm.

14. A method of testing a firearm, the method comprising:

removing a barrel from a firearm;

mounting the barrel to the carriage of the firearm support device of claim 1;

restricting the barrel to a single axis of movement; and firing a projectile from the barrel of the firearm with the striker assembly.

* * * * *